US007322422B2

(12) United States Patent
Patel

(10) Patent No.: US 7,322,422 B2
(45) Date of Patent: Jan. 29, 2008

(54) INFLATABLE PACKER INSIDE AN EXPANDABLE PACKER AND METHOD

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 644 days.

(21) Appl. No.: 10/414,586

(22) Filed: Apr. 16, 2003

(65) Prior Publication Data

US 2003/0196820 A1 Oct. 23, 2003

Related U.S. Application Data

(60) Provisional application No. 60/374,077, filed on Apr. 17, 2002.

(51) Int. Cl.
*E21B 23/06* (2006.01)

(52) U.S. Cl. ..... 166/387; 166/187; 166/278; 166/250.17

(58) Field of Classification Search ..... 166/387, 166/187, 278, 250.17, 250.07, 188, 207, 166/146, 147, 250.1
See application file for complete search history.

(56) References Cited

U.S. PATENT DOCUMENTS 2,812,025 A * 11/1957 Doherty et al. ..... 166/207
2,856,002 A * 10/1958 True et al. ..... 166/187
3,393,744 A * 7/1968 Fagg et al. ..... 166/187
3,477,506 A 11/1969 Malone
4,320,800 A 3/1982 Upchurch
4,345,648 A 8/1982 Kuus
4,580,632 A * 4/1986 Reardon ..... 166/250.17
4,838,349 A 6/1989 Berzin
5,105,881 A * 4/1992 Thoms et al. ..... 166/187
5,226,485 A * 7/1993 Dobscha et al. ..... 166/387
5,271,462 A 12/1993 Berzin
5,353,637 A * 10/1994 Plumb et al. ..... 166/250.1
5,547,029 A 8/1996 Rubbo et al.
5,555,945 A * 9/1996 Schultz et al. ..... 166/250.07
5,704,426 A 1/1998 Rytlewski et al.
5,810,083 A 9/1998 Kilgore
5,925,879 A 7/1999 Hay
6,109,357 A * 8/2000 Zimmerman ..... 166/387
6,247,536 B1 6/2001 Leismer et al.
6,257,338 B1 7/2001 Kilgore
6,263,966 B1 * 7/2001 Haut et al. ..... 166/278
6,286,603 B1 9/2001 Parent
6,302,216 B1 10/2001 Patel
6,311,772 B1 11/2001 Myhre et al.

(Continued)

FOREIGN PATENT DOCUMENTS

EP 0999343 A2 5/2000

(Continued)

*Primary Examiner*—Lanna Mai
*Assistant Examiner*—Matthew J. Smith
(74) *Attorney, Agent, or Firm*—Fred G. Pruner; Dona C. Edwards; Bryan P. Galloway

(57) ABSTRACT

A completion assembly for use in a well, including at least one inflatable packer; at least one control line and at least one source of pressurized fluid wherein the at least one source of pressurized fluid is in fluid communication with the at least one inflatable packer via the at least one control line.

46 Claims, 9 Drawing Sheets

U.S. PATENT DOCUMENTS

| | | | | |
|---|---|---|---|---|
| 6,328,113 | B1 | 12/2001 | Cook | |
| 6,457,518 | B1 * | 10/2002 | Castano-Mears et al. | 166/207 |
| 6,457,533 | B1 | 10/2002 | Metcalfe | |
| 6,564,870 | B1 * | 5/2003 | Grigsby et al. | 166/207 |
| 6,648,071 | B2 * | 11/2003 | Hackworth et al. | 166/207 |
| 6,712,141 | B1 * | 3/2004 | Bussear et al. | 166/250.17 |
| 6,742,598 | B2 * | 6/2004 | Whitelaw et al. | 166/387 |
| 6,799,637 | B2 * | 10/2004 | Schetky et al. | 166/207 |
| 6,854,522 | B2 * | 2/2005 | Brezinski et al. | 166/387 |
| 2002/0092658 | A1 | 7/2002 | Johnson et al. | |
| 2003/0000709 | A1 | 1/2003 | Gano | |

FOREIGN PATENT DOCUMENTS

| | | | |
|---|---|---|---|
| GB | 2321076 | A | 7/1998 |
| GB | 2335683 | A | 9/1999 |
| WO | WO 99/27224 | | 6/1999 |
| WO | WO 01/66906 | | 9/2001 |
| WO | WO03/102364 | A1 | 12/2003 |

* cited by examiner

INFLATABLE PACKER INSIDE AN EXPANDABLE PACKER AND METHOD

CROSS-REFERENCE TO RELATED APPLICATIONS

This invention claims priority pursuant to 35 U.S.C. § 119 of U.S. Provisional Patent Application Ser. No. 60/374,077, filed on Apr. 17, 2002. This Provisional Application is hereby incorporated by reference in its entirety.

BACKGROUND OF INVENTION

1. Field of the Invention

The present invention relates to well completion. More specifically, the invention relates to apparatus and methods for isolation of multiple zones of interest in a wellbore.

2. Background Art

It is often desirable to isolate portions of a well. For example, separate zones may be isolated from one another in order to separately control production from the zones or portions of a zone may be isolated to prevent or reduce production of water.

Isolation in an open hole is typically accomplished with external casing packers (ECP), which are inflatable packers. In a typical completion operation, the ECP is run with a completion string downhole. An inflate service tool may be run with the ECP or on a separate trip. Cement, mud, or some other type of fluid is then pumped into the packer for inflation. The fluids pumped into the packer are trapped inside the packer, which is a closed chamber once the inflation port is shut off.

Generally, the inflation pressure trapped in the packer is initially higher than the formation pressure in order to maintain positive contact with the wall of the well. However, the inflation pressure may decrease for various reasons such as cooling down during injection or production, an increase in the borehole size as a result of formation depletion or borehole wall deterioration, or a leak in the packer. In these cases, the packer may lose contact with the borehole wall and stop providing the desired isolation.

With current packer systems, a loss of seal between the packer and the casing or formation wall may not be repairable or may require numerous remedial trips into the well, resulting in increased risk of blow out, loss of production, or increased damage to zones of interest due to long or repetitive shut-in. Remedial operations are extremely expensive and time-consuming. A need, therefore, exists for improved methods and apparatus for providing isolation and other functionality in a well.

SUMMARY

In one aspect, embodiments of the invention relate to a completion assembly for use in a well. A completion assembly in accordance with one embodiment of the invention includes at least one inflatable packer, at least one control line, and at least one source of pressurized fluid wherein the at least one source of pressurized fluid is in fluid communication with the at least one inflatable packer via the at least one control line.

In another aspect, embodiments of the invention relate to a completion assembly for use in a well. A completion assembly in accordance with one embodiment of the invention includes an upper completion assembly including at least one control line, and a seal mechanism, and a lower completion assembly including at least one inflatable packer adapted to be in fluid communication with a source of pressurized fluid via the seal mechanism and the at least one control line.

In another aspect, embodiments of the invention relate to a completion assembly for use in a well. A completion assembly in accordance with one embodiment of the invention includes an upper completion assembly including at least one control line and at least one inflatable packer adapted to be in fluid communication with a source of pressurized fluid via the at least one control line, and a lower completion assembly comprising at least one expandable packer adapted to isolate two adjacent formation zones when the at least one inflatable packer is inflated to push the at least one expandable packer against a wall of the well.

In another aspect, embodiments of the invention relate to a completion assembly for use in a well. A completion assembly in accordance with one embodiment of the invention includes at least one inflatable packer adapted to be energized by a downhole energy source selected from the group including a mechanical spring, a gas accumulator, a compressible liquid accumulator, a nitrified gel, a material that swells when it comes in contact with a formation or injection fluid, or a downhole motor and pump.

In another aspect, embodiments of the invention relate to a completion assembly for use in a well. A completion assembly in accordance with one embodiment of the invention includes an upper completion assembly comprising at least one inflatable packer adapted to be energized by a downhole energy source selected from the group including of a mechanical spring, a gas accumulator, a compressible liquid accumulator, a nitrified gel, a material that swells when it comes in contact with a formation or injection fluid, or a downhole motor and pump, and a lower completion assembly comprising at least one expandable packer adapted to isolate two adjacent formation zones when the at least one inflatable packer is inflated to push the at least one expandable packer against a wall of the well.

Other aspects of the invention will become apparent from the following description, the drawings, and the claims.

DETAILED DESCRIPTION

Embodiments of the present invention relate to methods and apparatus for isolation in a well. A completion system in accordance with certain embodiments of the invention allows for monitoring of various characteristics to ensure isolation integrity, provides for a continuing source of energy to a packer such that the packer may maintain a positive contact with the borehole wall to ensure isolation, and/or allows the packer to be de-energized among other embodiments.

Figure 1:
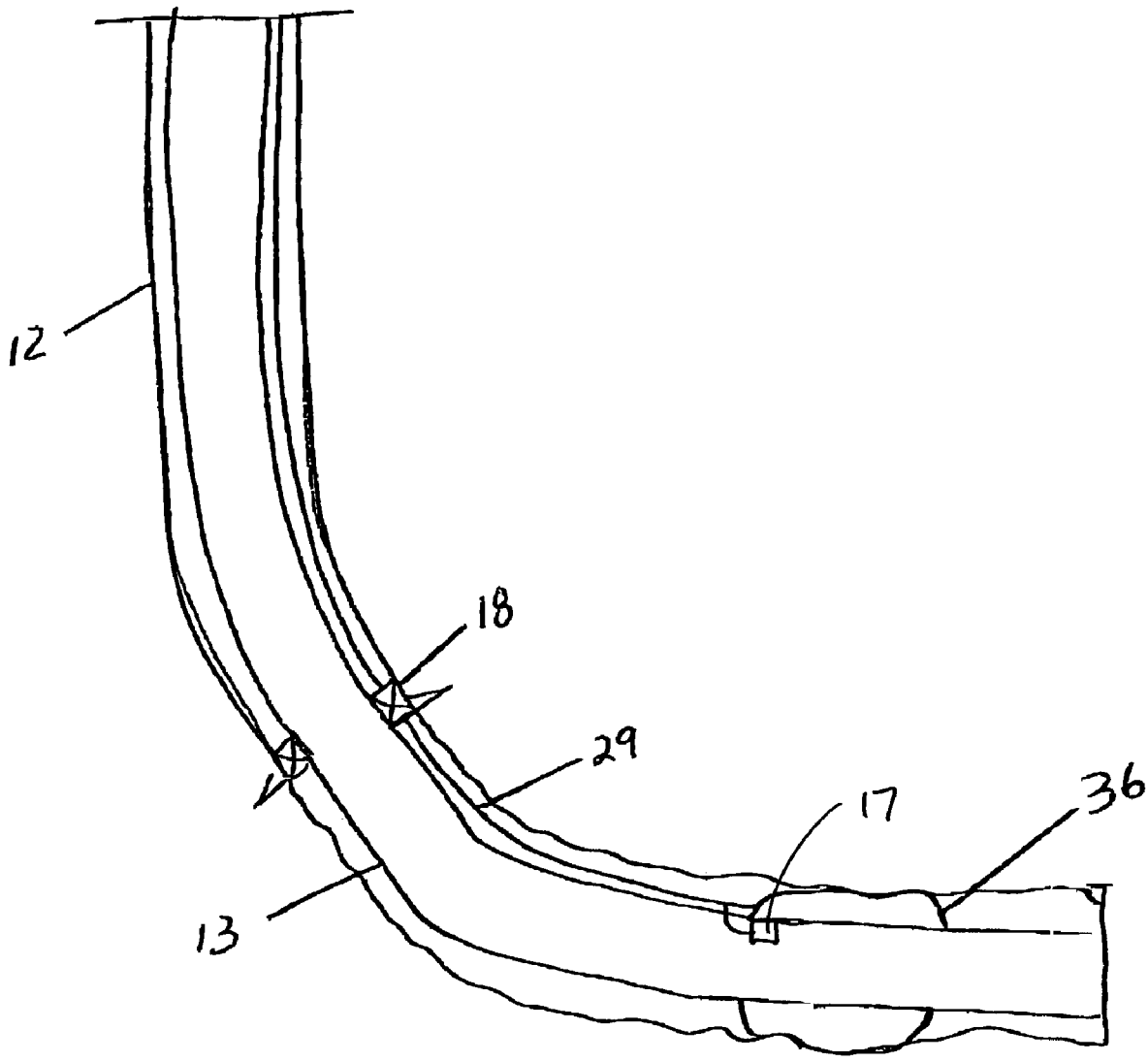
FIG. 1 illustrates a completion assembly according to one embodiment of the present invention.

FIG. 1 illustrates one embodiment of the present invention in which the well has an upper cased section 12 and a lower completion assembly which includes a production tubing string 13 and an external casing packer 36. Herein the terms external casing packer, ECP, inflatable packer, isolation packer, inflatable isolation packer, and the like are used interchangeably. In the embodiment shown, a control line 29 extends from the surface of the well, through production packer 18, to the ECP 36. Pressurized fluid provided through the control line 29 may be used to control the inflation pressure within the ECP 36, which provides isolation in the well. As used herein, the term "control line" includes passageways formed in various well components. In one alternative embodiment, a fiber optic line is provided to monitor the isolation packer 36. The fiber optic line may be provided as part of the control line 29 or as a separate line in the well. For example, the fiber optic line may provide a distributed temperature reading, pressure information, and other measurements for monitoring of the isolation packer 36. FIG. 1 also shows a sensor 17 adapted to measure a characteristic indicative of the inflation of the isolation packer 36. In this embodiment, the sensor 17 communicates with control line 29 that may incorporate an electric line therein.

Figure 2A:
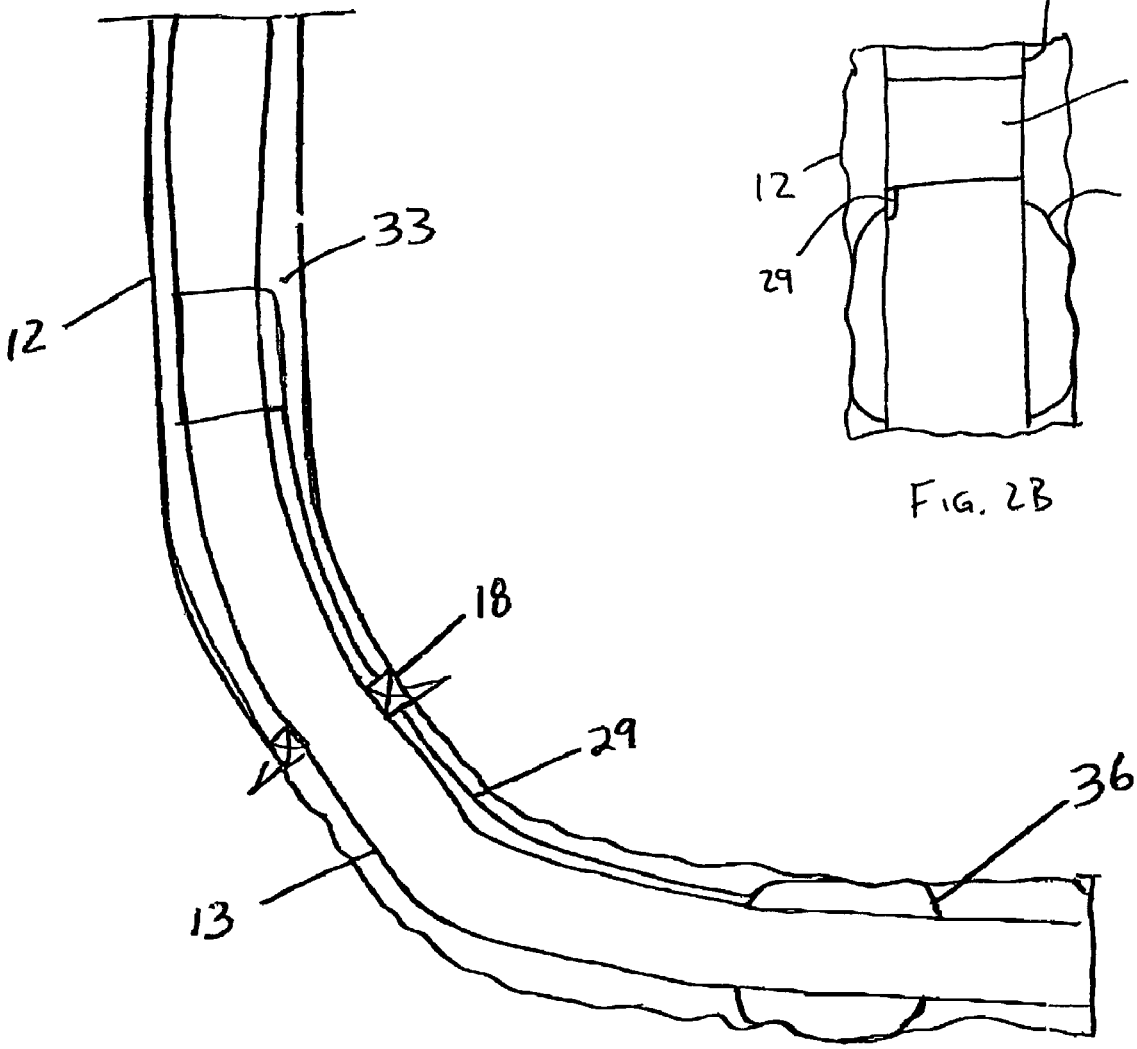
FIGS. 2A and 2B illustrate completion assemblies according to certain embodiments of the present invention.
Figure 2B:
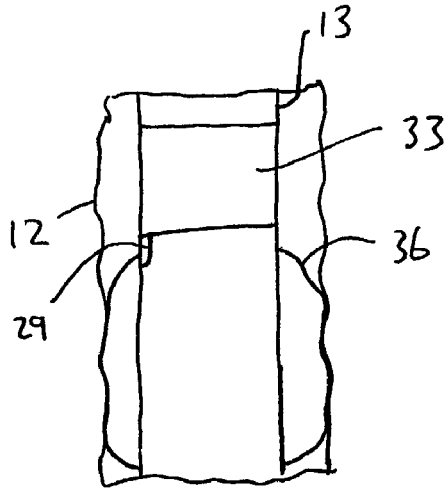

FIG. 2A illustrates one embodiment of the present invention in which the control line 29 extends from a device 33, through production packer 18 to ECP 36. Device 33 is positioned downhole as part of the completion. Device 33 may be any suitable device (e.g. a pump, a compressed fluid source, etc.) to provide an energy source to inflate ECP 36. FIG. 2B shows an alternative embodiment in which the device is positioned adjacent to the inflatable packer 36.

Figure 3:
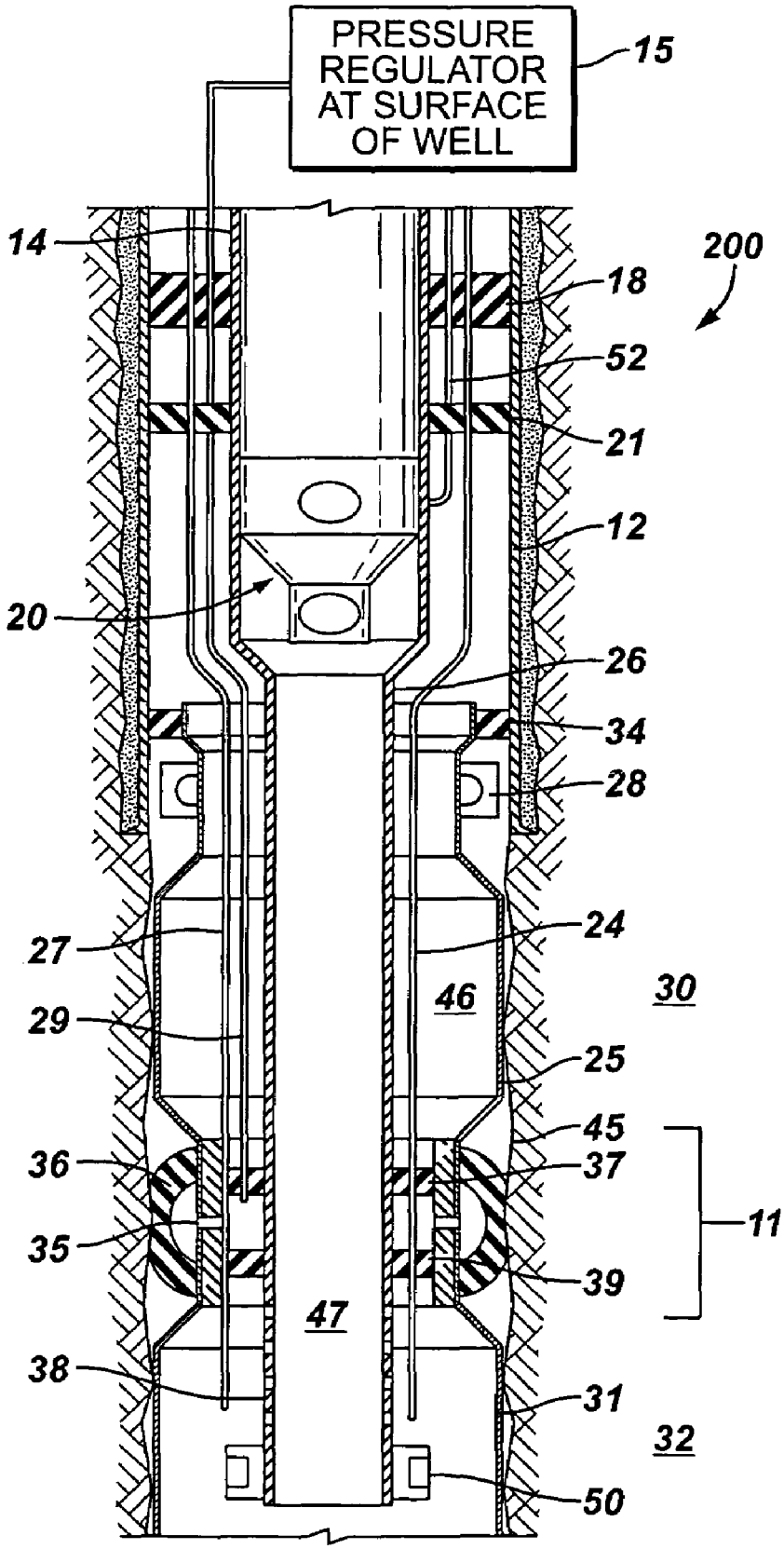
FIG. 3 illustrates a completion assembly according to one embodiment of the present invention.

FIG. 3 illustrates a completion system 200 according to one embodiment of the present invention. In this embodiment, a hydraulic control line 29 is run from the surface passing through a seal mechanism 11 (e.g., a straddle seal assembly that includes an upper element 37 and a lower element 39), which isolates the packer inflate port 35 from the wellbore 45. A seal mechanism 11 may be a straddle seal assembly as shown or any other suitable structure. The hydraulic control line 29 establishes communication with the control line fluid source (not shown) at surface or downhole, enabling the pumping of fluid through the hydraulic control line 29 to inflate the isolation packer 36. The pressure inside the packer 36 may then be monitored and/or controlled by pumping additional fluid into the packer 36 (or extracting fluid to prevent bursting of the packer in the event that heating or reduction in borehole size occurs). This allows for monitoring or confirming the integrity of isolation and for maintaining a proper pressure inside a packer.

A pressure regulator 15 at the surface of the well (or downhole) allows for maintenance of constant pressure in the packer 36 thus providing positive contact between the packer 36 and the wellbore 45 at all times. In this description, increasing pressure in an inflatable packer is referred to as "energizing" the packer, while decreasing pressure is referred to as "de-energizing."

One or more packers may be run in the hole to provide isolation in the well (e.g. zonal isolation). In addition, these packers may be used in tandem to provide isolation redundancy. All packers may be inflated or energized with the same control line (shown as 29 in FIG. 2) or with multiple control lines, which can be run through a packer inflate portal seal assembly in order to engage multiple packers. Alternately, a pressure distributor may be run downhole to divert the flow of pressurized fluid to each selected isolation packer. In this case, a single control line from the surface is run to the pressure distributor and then an individual control line is run from the pressure distributor to each packer. This will allow pressure in each packer to vary according to the pressure required to maintain positive contact with the wellbore.

In a smart well, at least one downhole flow control valve (choke) controls the flow from at least one zone. Multiple valves may be used to independently control the flow from multiple zones. In some cases, sensor lines are also used to monitor temperature and pressure or other measurements in each zone. Chemical injection lines may also be run for scale prevention or other requirements. Completion of a smart well generally requires multiple runs and, therefore, requires some type of wet connect to connect various sensor and control lines between surface and downhole, particularly when the well is gravel packed. Some embodiments according to the present invention allow for a multiple zone completion assembly to be installed in a smart well in a single trip. Other embodiments of the present invention may alternatively be installed in a two-stage operation with a wet connect of the type used, known or appreciated by one skilled in the art. A two-stage installation may be necessary in the event that reservoir stimulation, gravel packing or some other procedure is required prior to final installation of sensor and control lines, flow tube, flow control valve, etc. Embodiments of the present invention may be used in both smart wells and normal wells.

The completion system 200 illustrated in FIG. 3 is a single trip completion assembly. After installation of the isolation packer and expandable screens (collectively referred to as the lower completion assembly), the upper completion assembly may be installed in the well in a single trip, thus eliminating the need for a wet connect. The upper completion may comprise one or more of a sensor and control lines, flow tube, downhole flow control valve, and other conventional and smart completion equipment. Although FIG. 3 illustrates the invention used in connection with expandable sand screens, it should be noted that conventional sand screens may be used. Additionally, the isolation provided by the inflatable packer 36 makes it useful for other applications in which no screens are present.

As shown in FIG. 3, a lower completion assembly (shown as 300 in FIG. 4) may comprise an upper screen 25, a lower screen 31, and an inflatable packer 36. The screens 25 and 31 may be a wire-wrapped screen, an expandable screen, a gravel pack screen, a slotted screen, or other types of screens. The lower completion assembly (for sand face completion) is adapted to run in the well on a service tool (not shown) to a position below the liner hanger packer 34. In the illustrated embodiment, a formation isolation valve (FIV) 28 is located between the upper screen 25 and the liner hanger packer 34. The inflatable isolation packer 36 is typically in a deflated state while the lower completion assembly 300 is placed in the well. The inflatable packer 36 is disposed between the upper screen 25 and the lower screen 31 for the isolation of two or more zones 30 and 32.

In accordance with one embodiment of the invention, once the lower completion assembly is placed in the well, an upper completion assembly may then be run in the well to engage the lower completion assembly in a single trip. As shown in FIG. 5, the upper completion assembly may include, for example, a multiport production packer 18, a fluid loss control device 21, a multi-valve system 20, a slotted pup joint 38, FIV shifting tool 50, hydraulic control line 29 for energizing the inflatable isolation packer, control line 52 for actuating flow control valves in the multi-valve system 20, control line for pressure and temperature sensors 24, chemical injection line 27, and other lines for other sensors and various functions. The lower completion assembly (shown as 300 in FIG. 4) and the upper completion assembly (shown as 400 in FIG. 5) are for illustration only. One of ordinary skill in the art would appreciate that an upper completion assembly may include fewer or more components, depending on a particular operation.

The upper completion assembly (shown as 400 in FIG. 5) may be run in the hole as a single system. When the upper completion assembly (shown as 400 in FIG. 5) is in place, a seal mechanism 11 (e.g., a straddle seal assembly having an upper sealing element 37 and a lower sealing element 39 as shown) isolates the packer inflation port 35 from the wellbore fluid. When the upper completion assembly (shown as 400 in FIG. 5) engages the lower completion assembly (shown as 300 in FIG. 4), the seal mechanism 11 forms a fluid conduit linking the inflatable packer 36, via the packer inflation port 35, with the control line 29, which in turn connects to a source of pressurized fluid for energizing the inflatable packer 36. Thus, the inflatable packer 36 may be energized by pumping pressurized fluid from the source at the surface (or downhole) into the control line 29. The pressure in the control line 29 will rise as the inflatable packer 36 is energized. The pressure will rise rapidly once the inflatable packer 36 makes a contact with the wellbore 45, giving an indication that a contact has been made. At this point, further controlled increase in the inside pressure of the inflatable packer 36 will provide positive isolation between two zones 30 and 32. The pressure inside the inflatable packer 36 may be monitored at the surface or downhole. The pressure inside the inflatable packer 36 may be continuously or periodically monitored to maintain the isolation between zones 30 and 32.

FIG. 3 further illustrates that after the multiport production packer 18 and the fluid loss control device 21 are set in casing 12, the inflatable isolation packer 36 is inflated, the FIV 28 is opened, and the seal mechanism 11 (e.g., the straddle seal assembly 37 and 39) is set in place, the annular space 46 selectively communicates with zone 30 allowing selective flow from zone 30 through the multi-valve system 20. When flow tube 26, connected to production tubing 14, is also in place, annular space 47 selectively communicates with zone 32, allowing selective flow from zone 32 as well.

Figure 4:
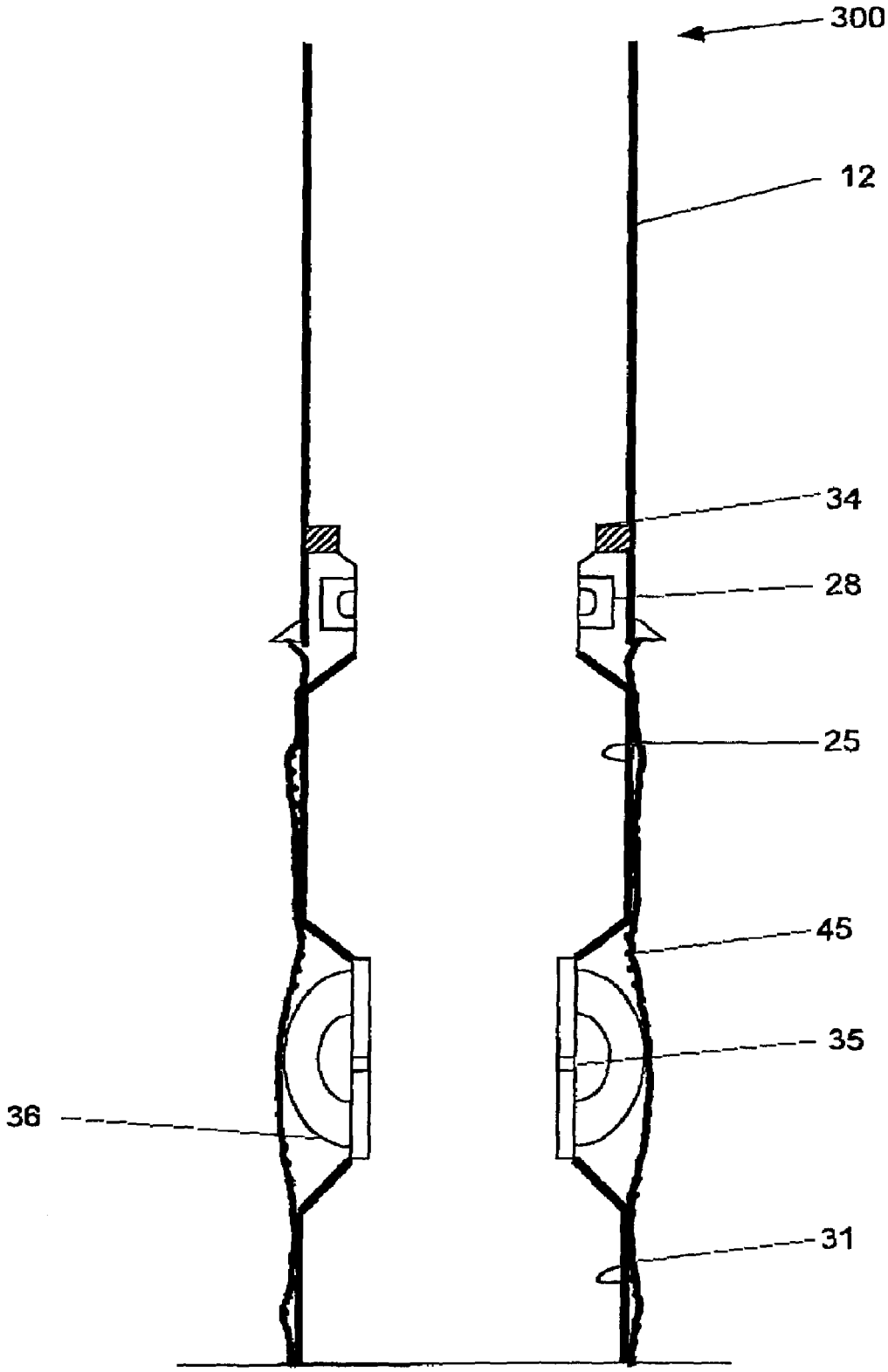
FIG. 4 illustrates a lower portion of a completion assembly according to one embodiment of the present invention.
Figure 5:
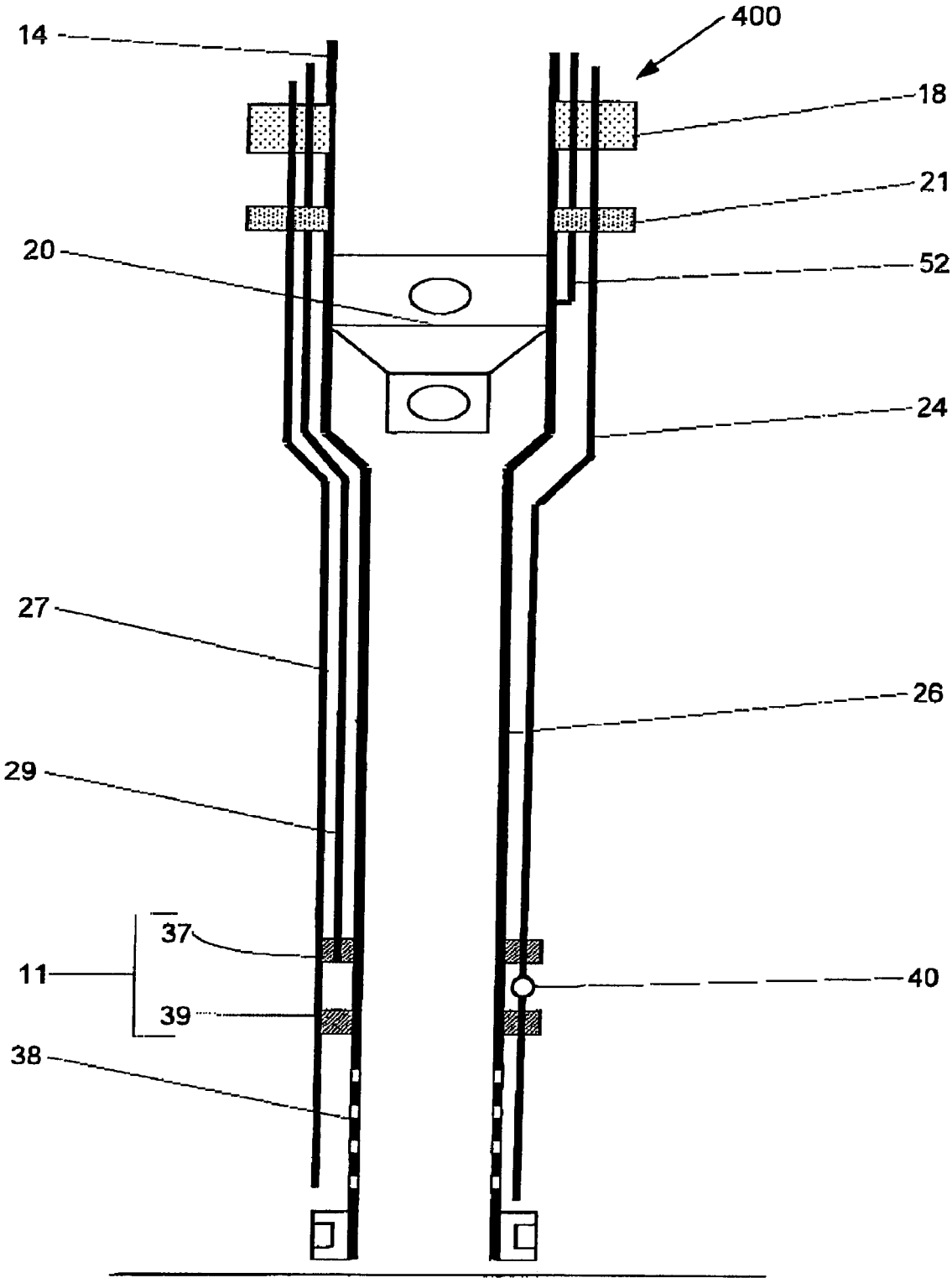
FIG. 5 illustrates an upper portion of a completion assembly according to one embodiment of the present invention.

FIG. 4 illustrates a lower completion assembly 300 according to one embodiment of the present invention. In this embodiment, a liner hanger packer 34 is adapted to sealingly mount to the lowermost section of casing 12. A formation isolation valve 28 is mounted between the liner hanger packer 34 and the upper screen 25. The inflatable isolation packer 36 is mounted between the upper screen 25 and the lower 31 in order to establish isolation of two adjacent zones. In operation, the screens 25, 31 and the inflatable isolation packer 36 are set in wellbore 45 proximate the zones of interest. When the upper completion assembly (shown as 400 in FIG. 5) engages the lower completion assembly 300, the seal mechanism (shown as 11 in FIG. 3 and FIG. 5) forms a fluid conduit linking the inflatable packer 36, via the packer inflation port 35, to the control line (shown as 29 in FIG. 3 and FIG. 5), thus allowing for monitoring, energizing, and/or deenergizing (or deflating) the isolation packer 36. As noted above, the lower assembly is typically run in the well with the inflatable isolation packer 36 in its deflated state.

FIG. 5 illustrates an upper completion assembly 400 according to one embodiment of the present invention. The upper completion assembly 400 shown in FIG. 5 may be run in the well as a single system (i.e., a single trip system). In a typical operation, the upper completion assembly 400 is run in on the end of production tubing 14. Then, the upper completion assembly 400 is set in casing by deploying the multiport production packer 18 and the flow loss control device 21. A multi-valve system 20 is disposed between the production tubing 14 and a flow tube 26 to allow for selective flow of multiple zones. Control line 52 is adapted to operate the flow control valves in the multi-valve system 20. A slotted pup (or pipe) joint 38 is located below the seal mechanism to allow for flow from a zone isolated below the inflatable isolation packer (shown as 36 in FIG. 3). Also, the slotted pipe 38 allows an operator to run and clamp various control lines outside the slotted pipe in the zone of interest, e.g. to deploy a fiber optics cable (not shown) for distributed temperature sensing, a chemical injection line 27, an electric line (not shown) etc. This configuration may be repeated for additional zonal isolation deeper in the well.

When the upper completion system 400 is in place (i.e., engages the lower completion assembly shown as 300 in FIG. 3), the seal mechanism 11 (e.g., the straddle seal assembly 37 and 39) isolates the packer inflation port (shown as 35 in FIG. 4). The inflatable isolation packer (shown as 36 in FIG. 4) is inflated or energized by pumping fluid, from the surface or downhole, through control line 29. The pressure inside the packer may be monitored by a pressure sensor 40, which, for example, may be located between the straddle sealing assembly elements 37 and 39. While the pressure sensor 40 is shown to be located downhole, one of ordinary skill in the art would appreciate that the pressure sensor 40 may be located anywhere along the control line 24 (or on the hydraulic control line 29) or on the surface. Alternatively, the back pressure, inside the packer, may be monitored at the surface via the sensor control line 24. Additionally, other sensors, for example a temperature sensor, may be included. Pressure inside the inflatable isolation packer 36 may be energized or de-energized to maintain or interrupt zonal isolation. In other embodiments according to the present invention, the control lines may be adapted to run through the seal mechanism 11 in order to communicate with additional inflatable isolation packers (not shown) that might be set deeper in the well. A chemical control line 27 may be adapted likewise to reach deeper zones.

Figure 6:
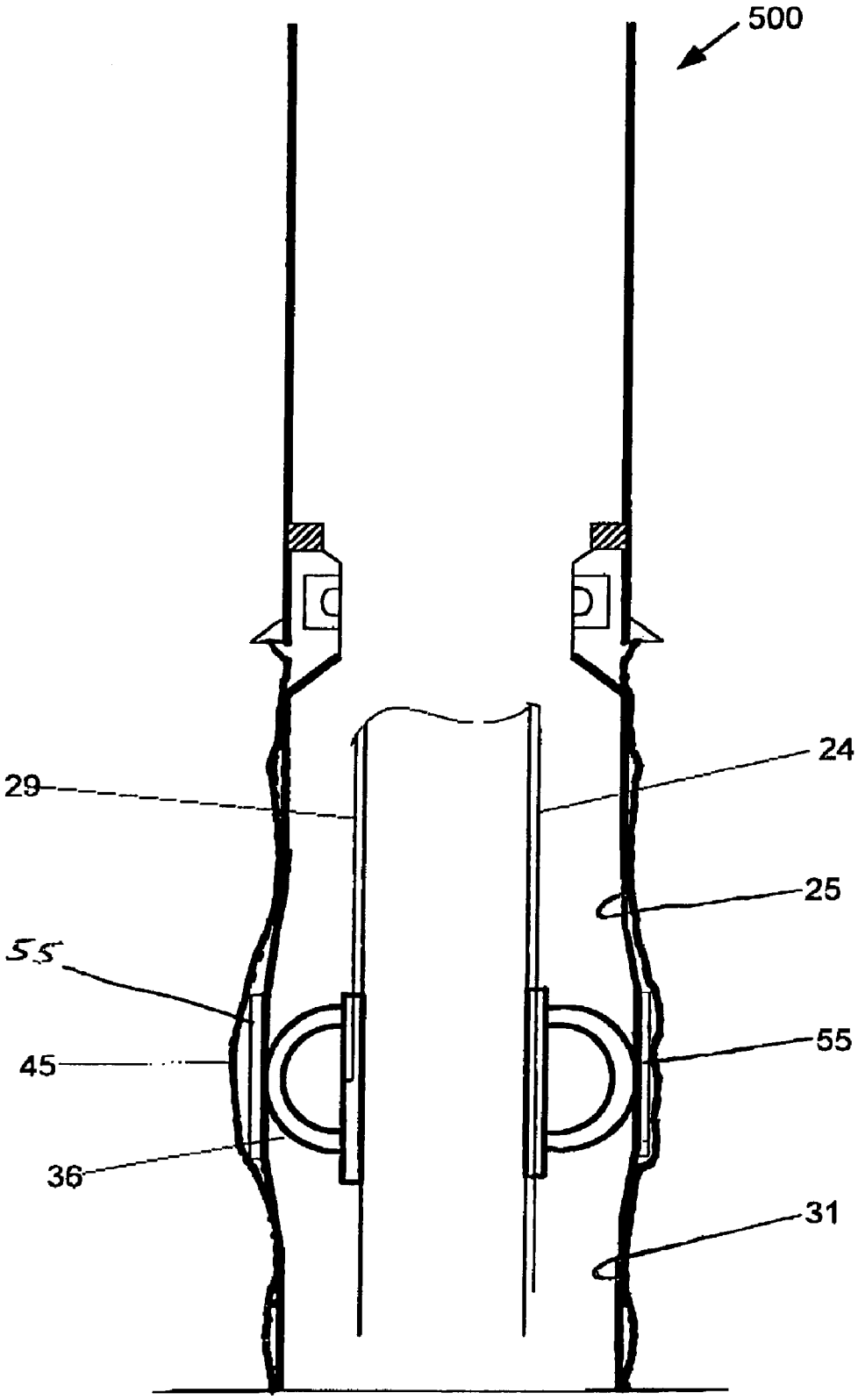
FIG. 6 illustrates an upper completion assembly with an inflatable packer according to one embodiment of the present invention.

The prior discussion describes an exemplary completion system in accordance with one embodiment of the invention. In the embodiment shown, an inflatable packer is included in a lower completion assembly and adapted to be in fluid communication with a control line in the upper completion assembly to permit maintaining/monitoring the pressure inside the inflatable packer to ensure a tight seal against the borehole wall. One of ordinary skill in the art would appreciate that other modifications to the embodiment shown are possible without departing from the scope of the invention. For example, FIG. 6 shows an alternative completion system 500 in accordance with another embodiment of the invention. In this embodiment, the inflatable packer 36 is included as part of an upper completion assembly, instead of a lower completion assembly.

As shown in FIG. 6, a lower completion assembly may include an external seal or expandable packer 55 disposed between the upper screen 25 and the lower screen 31, on the exterior thereof. An expandable packer 55 is a packer comprising an expandable tubing and a seal thereon. The upper screen 25 and the lower screen 31 may refer to two separate screens in some embodiments and to separate portions of a contiguous screen in other embodiments. For example, the screens 25, 31 and expandable packer 55 may be a contiguous assembly of expandable tubing products with portions having a screen material thereon and other portions having a seal thereon. The expandable packer 55 is adapted to form a tight seal with the wall of the borehole 45 to isolate the adjacent production zones or to prevent flow between the outside of the expandable packer and the wellbore. Note that the expandable packer 55 may be formed as an integral part of the screens 25 and 31. Alternatively, the expandable packer 55 may be an intermediary linking two separate (upper and lower) sections of the screen. In order to form a tight seal with the wall of the borehole 45, the expandable packer 55 is preferably made of a flexible material, such as a rubber, an elastomer, or any similar synthetic or natural material that can provide the desired seal.

In the completion system 500 shown in FIG. 6, the inflatable packer 36 is part of an upper completion assembly. Because the inflatable packer 36 is part of the upper completion assembly the hydraulic control line 29 can be run directly to the inflatable packer 36 in order to control the pressure inside the inflatable packer 36 without the need of a seal mechanism (e.g., the seal assembly 11 shown in FIG. 5). Similarly, the sensor control line 24 or other lines (e.g., chemical injection line 27 shown in FIG. 5) may be run past the inflatable packer 36 without a sealing assembly.

In operation, the lower completion assembly is lowered into the wellbore until the expandable packer 55 is positioned and expanded between the two adjacent zones to be isolated or at any other desired point of isolation. Then, the upper completion assembly is lowered and the inflatable packer 36 is positioned at the same axial depth as the expandable packer 55. According to one embodiment of the present invention, a pressurized fluid may then be pumped, either from the surface or from a downhole source, via the hydraulic control line 29 to inflate the packer 36. The inflated packer 36 pushes the expandable packer 55 against the wall of the borehole 45 to form a tight seal to isolate the two zones in the formation. In certain alternative embodiments, the pressure inside the packer 36 can then be monitored, either continuously or periodically, with a sensor (not shown) via the sensor control line 24, or, alternatively, by the control line 29. The alternative completion system 500 shown in FIG. 6 has the advantages of simple construction (no need for a sealing assembly) and the ease to service or repair the inflatable packer 36, should it fail. For example, in some cases in an expandable packer 55 may tend to relax after expansion in that the diameter of the expandable packer 55 becomes slightly reduced. In other cases the expandable packer 55 may not sufficiently engage the well after expansion to form a seal. The isolation packer 36 provides a force to maintain the desired seal and prevent relaxation of the expandable packer 55. The isolation packer 36 may also expand the expandable packer 55, either fully or partially (e.g., from an expanded state to a further expanded state). A standard isolation packer 36 may be used in combination with an expandable packer 55. In some embodiments, however, the isolation packer 36 has the other features described herein, such as a constant pressure source and/or monitoring to ensure the proper pressure is applied. These added features ensure that the seal from the expandable packer 55 is maintained. The isolation packer 36 provides isolation inside the outer completion.

During completion, it is sometimes desirable to maintain communication between zones of interest in the initial stages of a completion or production and then, at a later stage, to establish isolation. For example, it may be desirable to initially commingle production from two zones and then later to isolate the zones subsequent to the onset of water production in one of the zones. Likewise, it may be desirable to isolate a portion of a zone to prevent or reduce water production from the zone or for other reasons. Furthermore, it may be desirable to isolate zones initially and then break isolation at a later stage of the completion for various reasons: for example, to balance varying flow rates from multiple zones, to improve oil production from one zone by commingling with gas production from another zone, in the event one of the valve assemblies in the downhole flow control valve fails, or for other reasons. Therefore, it is desirable to have packers that can be deflated when necessary. Embodiments of the invention described above permit monitoring of the pressure inside a packer, reenergizing the packer, or de-energizing the packer when desired. In addition, the isolation packer can be energized continuously by continuous pumping of fluid, from the surface, in the event a leak develops in the packer (as long as the rate of pumping is greater than the rate of the leak). Also, a liquid sealant can be pumped through the control line or provided in a local reservoir in order to seal a leak. In the various described embodiments of the present invention, the liquid sealant is a pressure-activated sealant similar to that carried by companies such as Seal-Tite International. The sealant carries monomers and polymers in suspension. Such sealants are traditionally pumped downhole when a leak develops in the downhole tools, in the downhole equipment, or in the tubing. When the sealants flow out of a leak with a relatively high surface area to leak ratio, the monomers and polymers "coagulate" in a cross-linking mechanism across the leak, and cause it to "heal."

Figure 7:
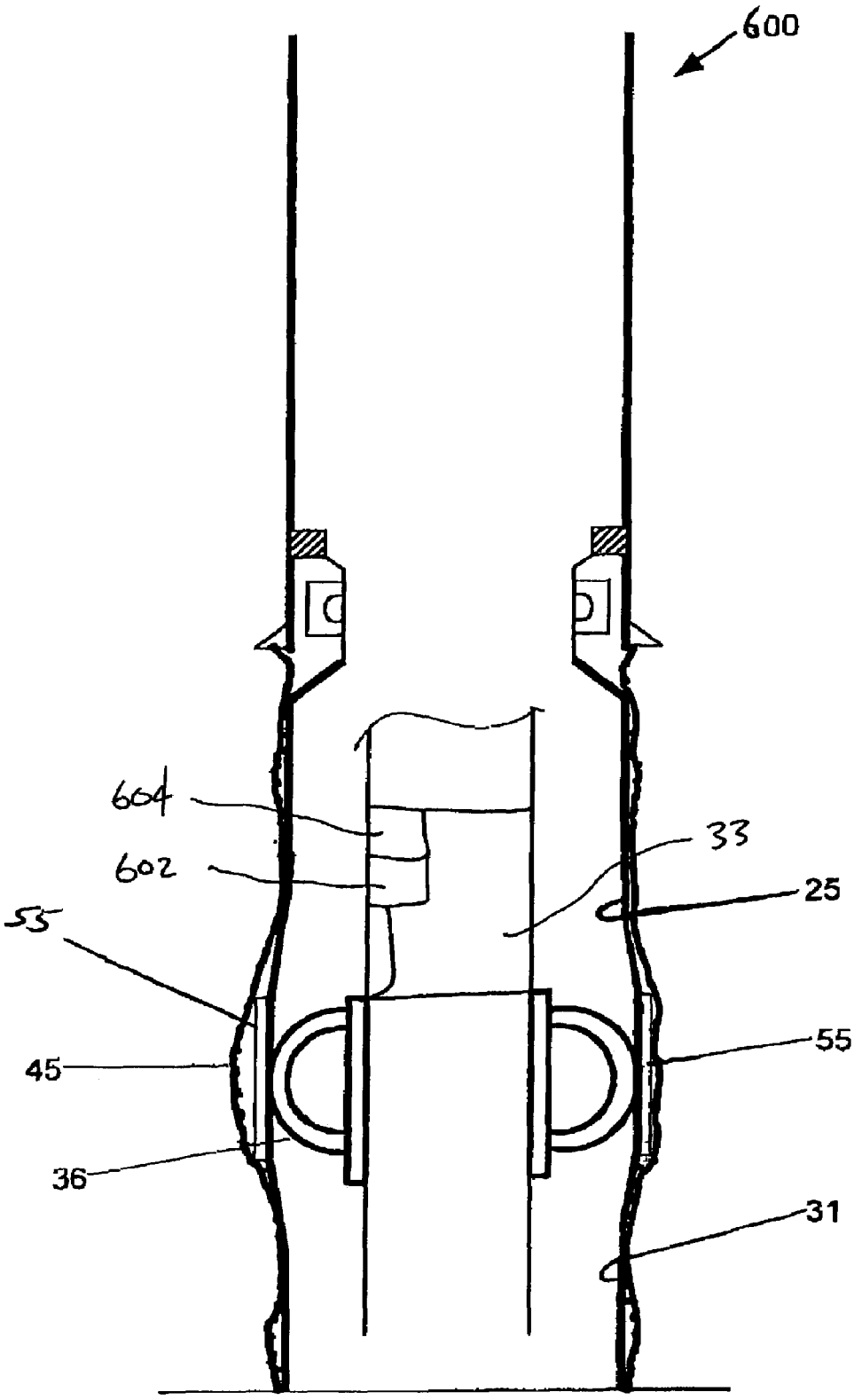
FIG. 7 illustrates an upper completion assembly with an inflatable packer according to one embodiment of the present invention.

Monitoring the pressure inside the isolation packer, may not be required in some situations. FIG. 7 illustrates a completion system 600, which uses an alternative isolation packer in accordance with one embodiment of the present invention. Rather than inflating or energizing the isolation packer via a control line, a downhole energization system may be used to inflate the isolation packer 36. A downhole energization system, for example, may comprise a gas accumulator, compressible liquid accumulator, mechanical spring energization, a specially formulated rubber or other material, appreciated by one of ordinary skill in the art, that swells and provides additional energy when it comes in contact with a formation fluid or an injection fluid, or a downhole motor and pump powered by a source including a downhole battery, a downhole fuel cell, a downhole generator driven by flowing formation or injection fluid, or an electric line to the surface. The downhole energization system maintains continuous pressure outward on the formation and therefore monitoring pressure via a control line is not required. FIG. 7 shows one embodiment having an expandable packer 55 provided with two sections of expandable screen 25 and 31, whereby the expandable packer 55 is disposed between the completion and the wall of the wellbore. As the isolation packer 36 is energized by downhole power source 33 (e.g., a pump and motor), it forms a seal with the expandable packer 55, and the expandable packer 55 forms a seal with the wall of the wellbore. FIG. 7 shows schematically a sensor 602 in device 33. The sensor measures one or more characteristics, such as pressure, temperature, flow, etc., indicative of the inflation of the isolation packer 36. A downhole controller 604 receives the data from the sensor 602 and operates the downhole power source 33 to ensure proper inflation of the isolation packer 36. For example, in the case of a downhole pump and motor powered by a power line to the surface or from a downhole power source, the controller 604 could turn the pump on and cause the isolation packer 36 to inflate as desired.

Figure 8:
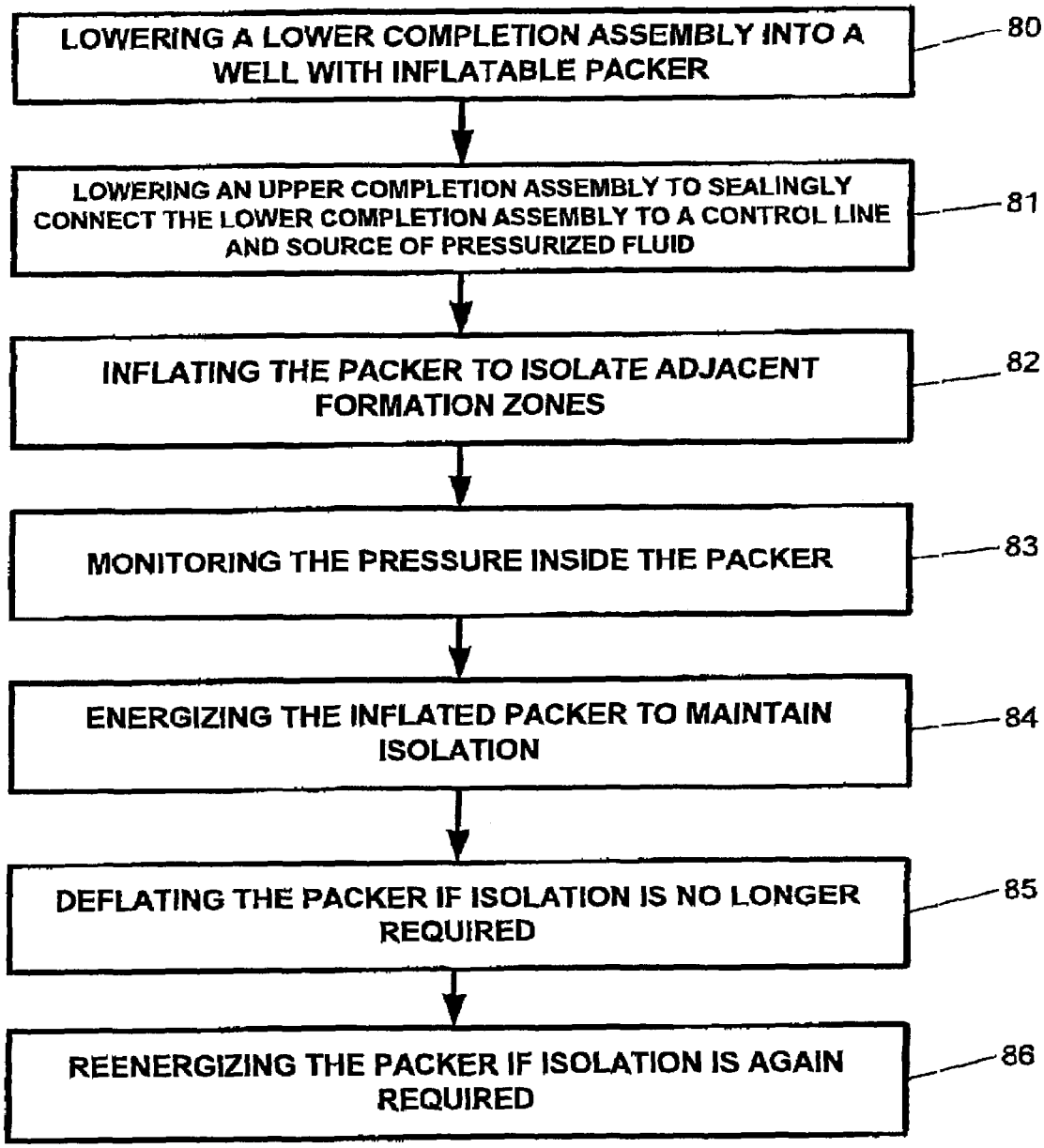
FIG. 8 illustrates a method according to one embodiment of the present invention.

FIG. 8 illustrates a method according to one embodiment of the present invention. First, a lower completion assembly including an inflatable packer is lowered into a well (shown as 80). Next, an upper completion assembly is lowered to sealingly connect with the lower completion assembly, thus allowing for fluid communication between the inflatable packer and a pressurized source of fluid via a control line (shown as 81). Then, the isolation packer is inflated with pressurized fluid via the control line to establish isolation (shown as 82). In some embodiments, the pressure inside the isolation packer may then be monitored (shown as 83). If required, the pressure inside the inflatable packer can be energized to maintain a seal with the formation (shown as 84), or, the inflatable packer can be deenergized (or deflated) in order to break isolation (shown as 85). In some situations, it may be desirable to reestablish the isolation by reenergizing the isolation packer to form a seal with the formation. Once the completion is in place the isolation packer can be inflated, energized, de-energized (or deflated) and reenergized whenever required to optimize production levels in the well.

Figure 9:
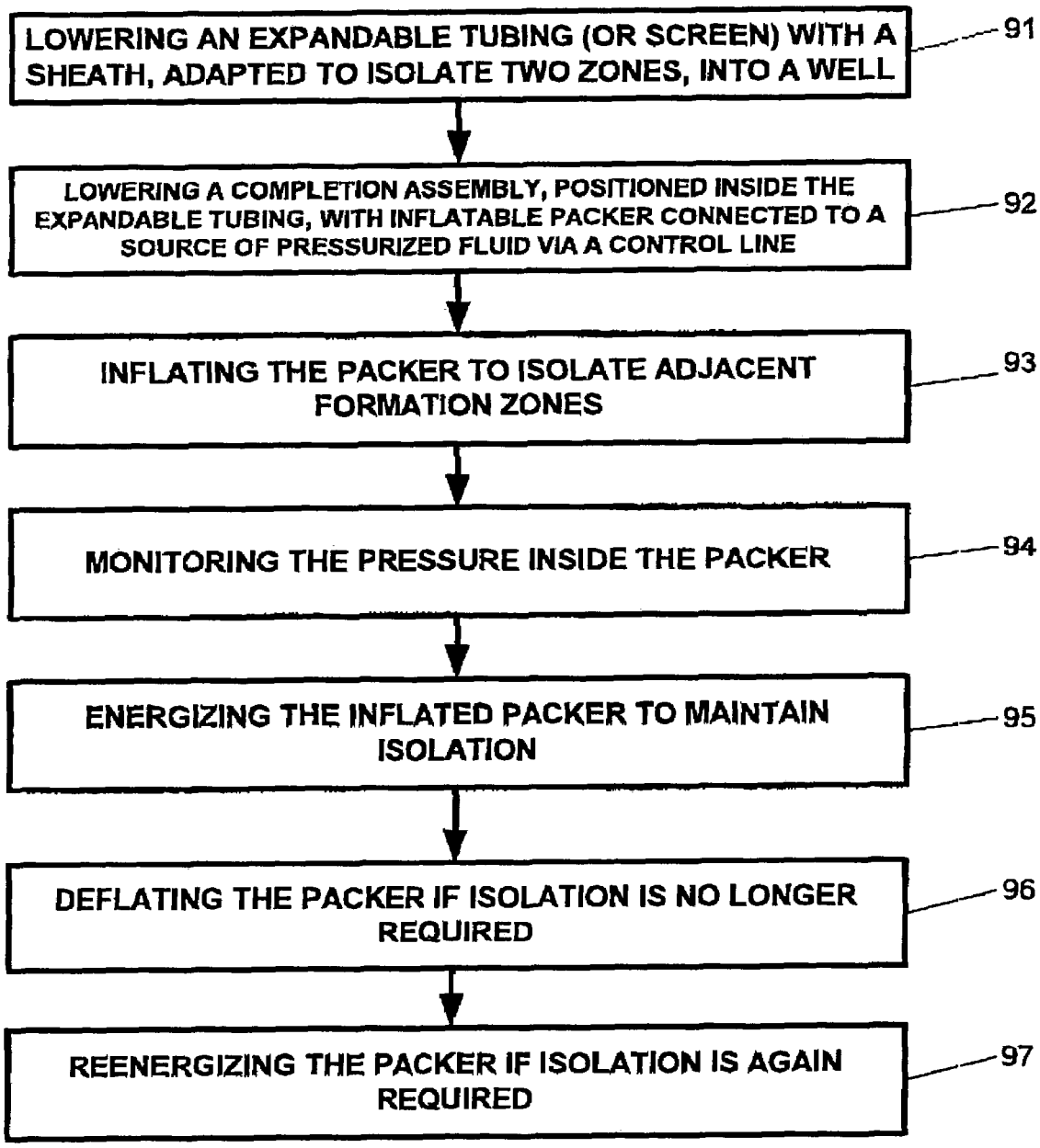
FIG. 9 illustrates a method according to one embodiment of the present invention.

FIG. 9 illustrates an alternative method according to one embodiment of the present invention. First, an expandable screen or tubing is lowered into the well, wherein the expandable screen has an expandable packer attached to its exterior (shown as 91). A completion assembly is then lowered into the well and positioned inside the expandable screen or tubing (shown as 92). The isolation packer may be connected to a source of pressurized fluid via a control line. Then, the isolation packer is inflated with the pressurized fluid via the control line to establish isolation of the two zones between which the inflatable packer is disposed (shown as 93). The pressure inside the isolation packer may be monitored (shown as 94). If required, the pressure inside the inflatable packer may be energized to maintain a seal with the formation (shown as 95), or, the inflatable packer can be de-energized (or deflated) in order to break isolation (shown as 96). In some situations, it may be desirable to reestablished isolation by reenergizing the isolation packer to form a seal with the formation (shown as 97). Once the completion is in place the isolation packer can be inflated, energized, deenergized (or deflated) and reenergized whenever required to optimize production levels in the well.

Note that in either method (shown in FIGS. 8 and 9) a downhole energization system instead of the pressured fluid on the surface may be used to inflate the isolation packer.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A completion system for use in a well, comprising:

an upper completion assembly comprising at least one control line, and a seal mechanism; and a lower completion assembly comprising at least one inflatable packer adapted to be in fluid communication with a source of pressurized fluid via the seal mechanism and the at least one control line, wherein the lower completion assembly is adapted to engage the upper completion assembly after the lower completion assembly is run into the well without the upper completion assembly.

2. The completion system of claim 1, further comprising at least one flow control valve disposed in the upper completion assembly.

3. The completion system of claim 1, further comprising at least one expandable tubing disposed in the lower completion assembly.

4. The completion system of claim 1, further comprising at least one screen disposed in the lower completion assembly.

5. The completion system of claim 1, wherein the seal mechanism comprises a straddle seal assembly.

6. The completion system of claim 1, wherein the source of pressurized fluid is adapted to control a pressure inside the at least one inflatable packer.

7. The completion system of claim 1, further comprising a pressure distributor operatively coupled to the at least one control line and adapted to control a pressure inside the at least one inflatable packer.

8. The completion system of claim 1, further comprising at least one pressure sensor adapted to measure a pressure inside the at least one inflatable packer.

9. The completion system of claim 8, wherein the at least one pressure sensor is connected to the at least one control line.

10. The completion system of claim 1, wherein the source of pressurized fluid is located at surface.

11. The completion system of claim 1, wherein the source of pressurized fluid is located downhole.

12. A completion system for use in a well, comprising:

an expandable packer; and an inflatable packer adapted to be run in the well and be disposed in the expandable packer to engage and expand the expandable packer, wherein the expandable packer is adapted to be run in the well before the inflatable packer is run in the well.

13. The completion system of claim 12, wherein the expandable packer comprises a seal thereon.

14. The completion system of claim 12, wherein the inflatable packer exerts a force against the expandable packer.

15. The completion system of claim 12, further comprising: a source of pressurized fluid in communication with the inflatable packer and adapted to control a pressure inside the inflatable packer.

16. The completion system of claim 12, further comprising at least one pressure sensor adapted to measure a pressure inside the inflatable packer.

17. The completion system of claim 12, further comprising at least one sensor adapted to measure a characteristic indicative of the inflation of the inflatable packer.

18. The completion system of claim 12, further comprising a fiber optic line in the well adapted to measure a characteristic of the inflatable packer.

19. The completion system of claim 12, wherein the expandable packer comprises a tubular member and a sealing element that circumscribes the tubular member, and the inflatable packer is adapted to be disposed in the expandable packer such that the tubular member circumscribes the inflatable packer.

20. The completion system of claim 19, wherein the tubular member comprises a screen.

21. The completion system of claim 12, wherein the expandable packer comprises:

an expandable tubing adapted to expand in response to expansion of the inflatable packer; and sealing element adapted to expand with the expandable tubing in response to the expansion of the inflatable bladder.

22. A method for zonal isolation in a well, comprising:

placing a lower completion assembly into the well, wherein the lower completion assembly comprises at least one inflatable packer;

running an upper completion assembly into the well to engage the lower completion assembly, the upper completion assembly comprising a control line in fluid communication with a source of pressurized fluid;

establishing fluid communication between the control line and the inflatable packer when the upper completion assembly and the lower completion assembly are engaged inflating the at least one inflatable packer; and monitoring a pressure inside the at least one inflatable packer.

23. The method of claim 22, further comprising maintaining the pressure inside the at least one inflatable packer at a selected pressure, wherein the maintaining comprises energizing or deflating the at least one inflatable packer via the at least one control line.

24. The method of claim 22, wherein the monitoring is performed at surface.

25. The method of claim 22, wherein the source of pressurized fluid is located at surface.

26. The method of claim 22, wherein the source of pressurized fluid is located downhole.

27. A method for zonal isolation in a well, comprising initially expanding an expandable packer in the well, the initial expansion leaving the expandable packer in a state in which the expandable packer does not form an annular seal in the well; subsequently inflating an inflatable packer inside the expandable packer; and expanding the expandable packer in response to the inflation of the inflatable packer to form the annular seal.

28. The method of claim 27, further comprising monitoring a pressure inside the at least one inflatable packer.

29. The method of claim 27, further comprising maintaining the pressure inside the at least one inflatable packer at a selected pressure.

30. The method of claim 27, further comprising:

deploying the expandable packer downhole in a first run; and deploying the inflatable packer downhole in a second run other than the first run.

31. The method of claim 27, further comprising:

expanding the expandable packer to form a seal between a screen and a wellbore wall.

32. The method of claim 27, further comprising:

forming an annular seal at least partially surrounding the expandable packer in response to the inflation of the inflatable packer.

33. A method for zonal isolation in a well, comprising:

initially expanding an expandable completion in a well, the expandable completion comprising an expandable sand screen and an expandable packer and the initial expansion leaving the expandable packer in a state in which the expandable packer does not form an annular seal in the well;

after the expanding, running a completion into the expandable completion, the completion comprising an inflatable packer; and inflating the inflatable packer to engage and expand the expandable packer to form the annular seal.

34. The method of claim 33, further comprising maintaining the pressure in the inflatable packer at a predetermined pressure.

35. The method of claim 33, further comprising pumping a fluid into the inflatable packer to maintain a desired pressure therein.

36. The method of claim 33, further comprising measuring a pressure in the inflatable packer.

37. The method of claim 36, further comprising providing additional fluid to the inflatable packer based on a measurement from the measuring step.

38. The method of claim 33, further comprising expanding the expandable packer with the inflatable packer.

39. The method of claim 33, further comprising forcing the expandable packer against the well with the inflatable packer.

40. The method of claim 33, further comprising measuring a characteristic of the inflatable packer using a fiber optic line.

41. The method of claim 33, further comprising isolating adjacent zones of the well with the expandable packer and the inflatable packer.

42. A completion system for use in a well, comprising:

an expandable packer;

an inflatable packer adapted to be run in the well separately from the expandable packer and be disposed in the expandable packer to engage the expandable packer; and at least one flow control valve interconnected to the inflatable packer via an upper completion assembly.

43. The completion system of claim 42, further comprising:

a source of pressurized fluid in communication with the inflatable packer and adapted to control a pressure inside the inflatable packer.

44. The completion system of claim 42, further comprising at least one pressure sensor adapted to measure a pressure inside the inflatable packer.

45. The completion system of claim 42, further comprising at least one sensor adapted to measure a characteristic indicative of the inflation of the inflatable packer.

46. The completion system of claim 42, further comprising a fiber optic line in the well adapted to measure a characteristic of the inflatable packer.

* * * * *